US005791282A

United States Patent [19]

Christ-Janer

[11] Patent Number: 5,791,282

[45] Date of Patent: Aug. 11, 1998

[54] FIRE DETECTION PORT

[76] Inventor: Victor Christ-Janer, 77 Frogtown Rd., New Canaan, Conn. 06840

[21] Appl. No.: 478,348

[22] Filed: Jun. 7, 1995

[51] Int. Cl.[6] ..... G08P 5/40; G08B 7/00

[52] U.S. Cl. ..... 116/5; 116/70; 116/214

[58] Field of Search ..... 116/5, 24, 67 R, 116/70, 214, DIG. 22, 2; 49/70, 171; 454/195, 357

[56] References Cited

U.S. PATENT DOCUMENTS

| | | | |
|---|---|---|---|
| 700,864 | 5/1902 | Weinberg | 116/70 |
| 4,569,208 | 2/1986 | Villa | 454/195 X |

FOREIGN PATENT DOCUMENTS

| | | | |
|---|---|---|---|
| 2635140 | 2/1990 | France | 49/171 |
| 549795 | 5/1932 | Germany | 116/70 |
| 563913 | 9/1944 | United Kingdom | 116/67 R |

*Primary Examiner*—Thomas B. Will
*Assistant Examiner*—Willie Morris Worth
*Attorney, Agent, or Firm*—Patrick J. Walsh

[57] ABSTRACT

A fire detection port installed in doors of occupied structures provides visible and audible signals on one side of a door in the event of fire on the other side of the door.

6 Claims, 2 Drawing Sheets

FIRE DETECTION PORT

BACKGROUND OF THE INVENTION

The present invention relates to fire detection in occupied structures, and particularly for providing a signal to occupants in the vicinity of a fire occurring within the structure.

Fire alarms and smoke detectors are in common use for signalling the presence of smoke and fire in an occupied structure. The alarm given is a general one and its purpose is to alert occupants to immediately leave the structure. In case of a fire alarm, building occupants often do not know the exact location of the fire nor the path of movement of the fire through the building. It is potentially dangerous then for an occupant to open an apartment or office door to a hallway if the fire is progressing along the hallway. The occupant in responding to the alarm may be unaware of the danger and attempt to exit the building in the usual manner by using the hallway and stair well.

There is need for a signalling device for warning building occupants as to the presence of fire in an adjacent hallway or room so that the occupants will avoid unwittingly entering a conflagration in the building.

SUMMARY OF THE INVENTION

The present invention comprises a fire detection port for warning occupants and firemen of the presence of fire in an adjacent space of a building.

In a preferred embodiment, the detector comprises a tube fitted with a whistle and mounted through a building partition such as a door or wall to alert occupants in the event of fire on the other side of the door or wall. In the event of fire, smoke and hot air generated by the fire pass through the detector and provide visual and audible signals that fire exists on the other side of the door or wall.

In case of fire, a pre-existing alarm system sounds a warning throughout the building prompting the occupants to leave immediately. The fire detector port of the invention when installed in doors throughout the building provides a specific visual and audible signal that fire exists on the other side of a door, that the door is not to be opened and that the occupant should seek another route out of the building.

OBJECTS OF THE INVENTION

An object of the invention is to provide a fire detector for each room and passageway of a building.

Another object of the invention is to provide a fire detection port for building doors and walls for alerting occupants in the immediate vicinity of the presence of fire.

Another object of the invention is to provide a fire detection port for building doors to provide audible and visual indications of fire on the other side of the door.

Another object of the invention is to provide a fire detection port which is economical to manufacture and install, and which reliably provides warning of fire in a building.

Another object of the invention is to provide a fire detection port to supplement a building's general fire alarm by providing room occupants of the presence of fire on the other side of building doors.

Another object of the invention is to provide a bidirectional fire detection port for building doors and walls for alerting occupants on either side of a door that there is fire on the other side.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
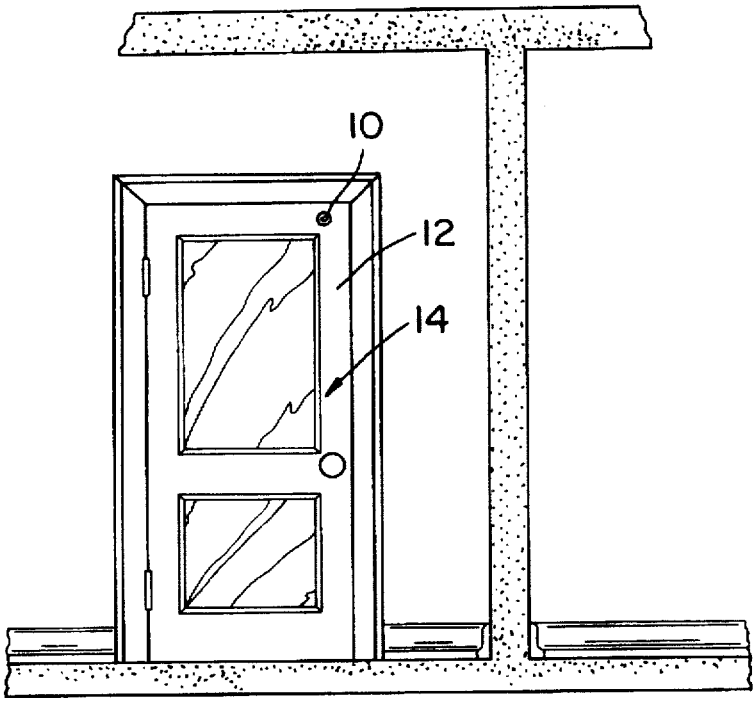
FIG. 1 is a front elevational view showing typical placement of a fire detector port according to the invention.
Figure 2:
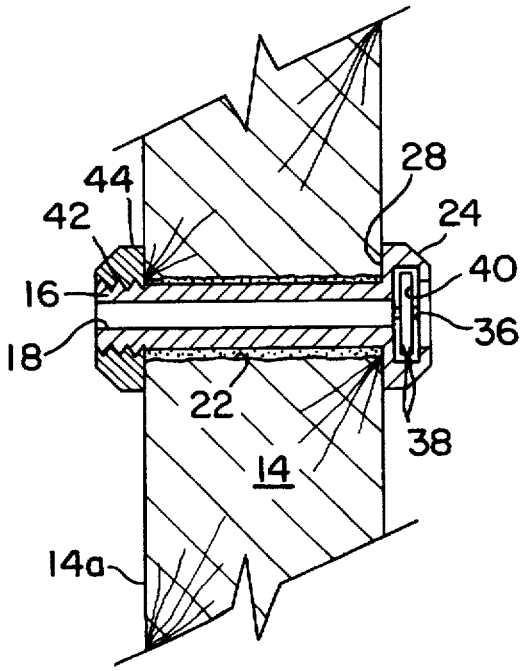
FIG. 2 is an enlarged section view showing installation of the detector in a door.
Figure 3:
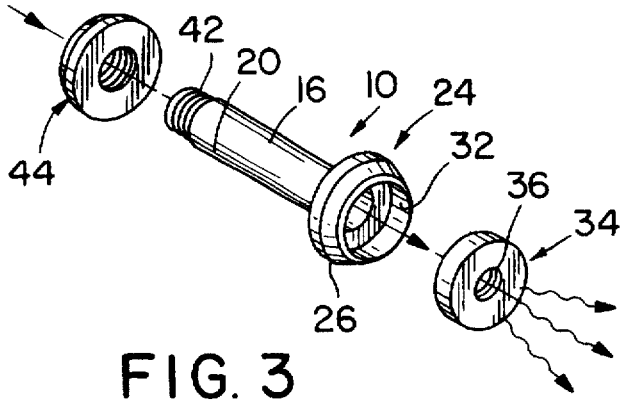
FIG. 3 is an exploded perspective view of the components of a fire detector port according to the invention.
Figure 4:
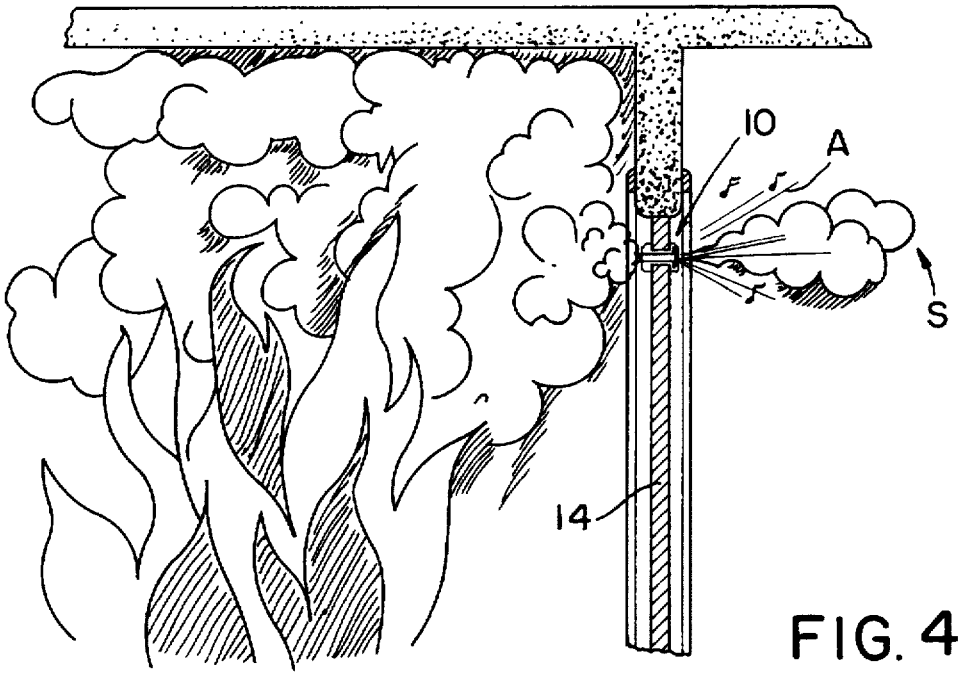
FIG. 4 is a side elevational view partially in section showing operation of the fire detector port in the event of fire on one side of a building door.
Figure 5:
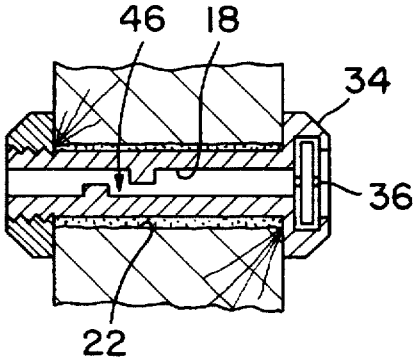
FIG. 5 is an enlarged section view of a modified embodiment of the invention showing installation of the detector in a door with the detector having means for interrupting a direct line of sight through the detector.

Referring now to the drawing, the fire detector 10 is preferably mounted near the top 12 of an interior door 14 of a building including residential, commercial, industrial, and hotel structures.

The detector comprises an elongate tube 16 defining an internal passage 18 for flow of hot air A and smoke S from one side **14*a* to the other side 14*b* of the door. The tube is preferably cylindrical with smooth outer surface 20 and is of sufficient length to pass through an opening 22 drilled through the door. The tube includes a head member 24 in the form of a disc 26 preferably formed integral with the tube. The inner surface of the disc defines an abutment shoulder 28 for positioning the detector with respect to a door surface 14*b*. The front face 30 of the disc includes an open cavity 32 of generally cylindrical shape for receiving a signalling device 34. The preferred signalling device is a whistle which sounds as air flows in either direction through an orifice 36 in the whistle body. The whistle comprises mating discs 38 defining a whistle chamber 40. The whistle is permanently fitted into the open cavity as by a press fit. The detector tube 16 also includes suitable means for securing the detector in place in the door such as a threaded end 42 for receiving a retaining nut 44**.

The detector body is fabricated of fire resistant such as brass and the whistle of sheet steel.

The detector may be installed with the whistle located on either side of the door because the detector is bidirectional and is effective to provide a visible signal, i.e., smoke, as well as an audible signal, i. e., whistling sound on either side of the door. In the event of fire in a room or hallway on one side of the door, hot air and smoke rise to the top and pass through the detector issuing a cloud of smoke and a whistling sound on the other side of the door alerting building occupants and firemen to the presence of fire on the one side of the door.

A modification of the invention is shown in FIG. 6, in which means in the form of a maze or baffle 46 is located within the detector passage to interrupt a sight line through the detector for privacy of the occupants, while freely allowing passage of smoke and hot air in the event of fire and performing the dual signalling function.

The fire detector port according to the invention augments an existing alarm system that sounds a general fire warning throughout a building prompting the occupants to leave immediately. The fire detector port of the invention when installed in doors throughout the building supplements the existing system by providing both occupants and firemen with a specific visual and audible signal that fire exists on the other side of a door within the building, that the door is not to be opened and that the occupant should seek another route out of the building.

I claim:

1. A fire detector port in combination with a partition in an occupied building, the fire detection port comprising an elongate tube for extending through the partition and defining a passage for conducting hot air and smoke from one side of the partition to the other side, and means cooperating with the tube for providing an audible signal in response to the passage of air through the tube whereby the detector provides visual and audible signals on the other side of the partition when there is fire on the one side of the partition.

2. A fire detector port in combination with a door in an occupied building, the fire detection port comprising an elongate tube extending horizontally through the door from one side to the other side and defining a passage for conducting hot air and smoke from the one side of the door to the other side, and a whistle cooperating with the tube for providing an audible signal in response to the passage of air through the tube whereby the detector provides visual and audible signals of fire on the one side of the door.

3. A fire detector port in combination with a door in an occupied building, the fire detection port comprising an elongate tube for extending horizontally through the door from one side to the other and defining a passage for conducting hot air and smoke from the one side of the door to the other side, the tube having a head portion for positioning the tube with respect to the surface of one side of the door, the head having an open-ended cavity communicating with the passage, a whistle positioned in the cavity, the whistle having an orifice communicating with the passage for providing for the flow of smoke and for an audible signal in response to the passage of air through the tube and whistle orifice whereby the detector provides visual and audible signals of the existence of fire on the one side of the door.

4. A fire detector port as defined in claim 2 in which the tube and whistle are fabricated of fire resistant material.

5. A fire detector port as defined in claim 2 in which the tube is fabricated of brass and the whistle of sheet steel.

6. A fire detector port in combination with a door in an occupied building, the fire detection port comprising an elongate tube for extending horizontally through the door from one side to the other side and defining a passage for conducting hot air and smoke from the one side of the door to the other side, a whistle cooperating with the tube for providing an audible signal in response to the passage of air through the tube whereby the detector provides visual and audible signals of fire on the one side of the door, and the tube including means for interrupting a line of sight through the passage.

* * * * *